United States Patent [19]

Bateman

[11] Patent Number: 4,784,425

[45] Date of Patent: Nov. 15, 1988

[54] COACH SEAT LOCKING MECHANISM

[75] Inventor: Robert Bateman, Levittown, Pa.

[73] Assignee: Trison Associates Incorporated, Feasterville, Pa.

[21] Appl. No.: 74,346

[22] Filed: Jul. 16, 1987

[51] Int. Cl.[4] ..... B60N 1/02

[52] U.S. Cl. ..... 296/65.1; 297/349; 248/418; 105/345

[58] Field of Search ..... 296/65 R; 297/349; 248/418; 105/345

[56] References Cited

U.S. PATENT DOCUMENTS

| | | | |
|---|---|---|---|
| 2,822,858 | 2/1958 | Mussler | 297/349 |
| 2,992,852 | 7/1961 | Loofbourrow | 297/349 |
| 3,860,283 | 1/1975 | Colautti | 296/65 R |
| 3,926,396 | 12/1975 | Hall et al. | 248/418 |
| 4,518,139 | 5/1985 | Barfell | 248/418 |
| 4,705,256 | 11/1987 | Hofrichter | 248/418 |

*Primary Examiner*—Robert R. Song

*Attorney, Agent, or Firm*—Steele, Gould & Fried

[57] ABSTRACT

A coach seat locking mechanism is disclosed which is compatible for use with existing revolving type coach seats. A metallic body having a vertical bore is affixed to one end of the seat lower frame and a locking rod is vertically reciprocal within the bore between an upper, locking postion and a lower, unlocked postion. A pedal arm having a cam is pivotally affixed to the body and is designed for foot operation form an upper, locking position to a lower, unlocked position. Upon depressing the pedal arm, the locking rod is lowered to its unlocked position and simultaneouly, the pedal cam contacts a body affixed extraction arm to transversely move the seat upper frame away from the coach sidewall. A detent is pivotally secured to the body to maintain the pedal arm in its unlocked position. Upon rotating the seat upper frame through one hundred and eighty degrees, the parts are automatically returned to their initial, unlocked positions to thereby prevent seat upper frame rotation even under the most severe or stressed conditions.

19 Claims, 4 Drawing Sheets

FIG. 1
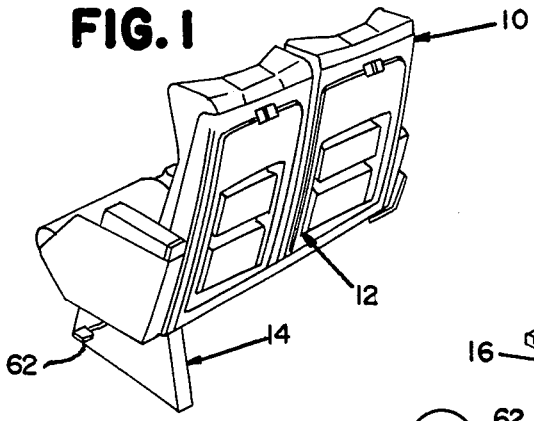
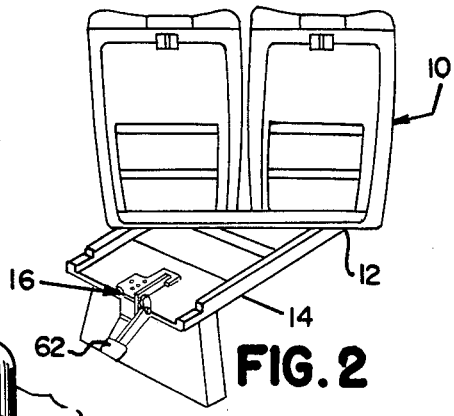
FIG. 2
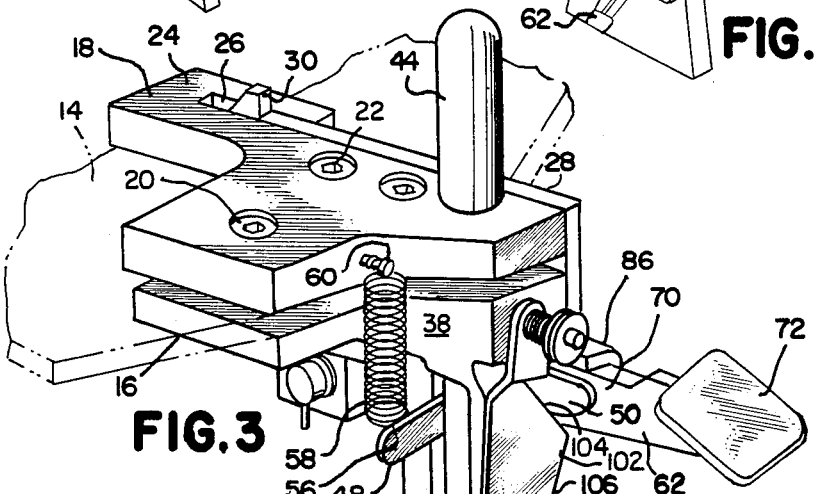
FIG. 3
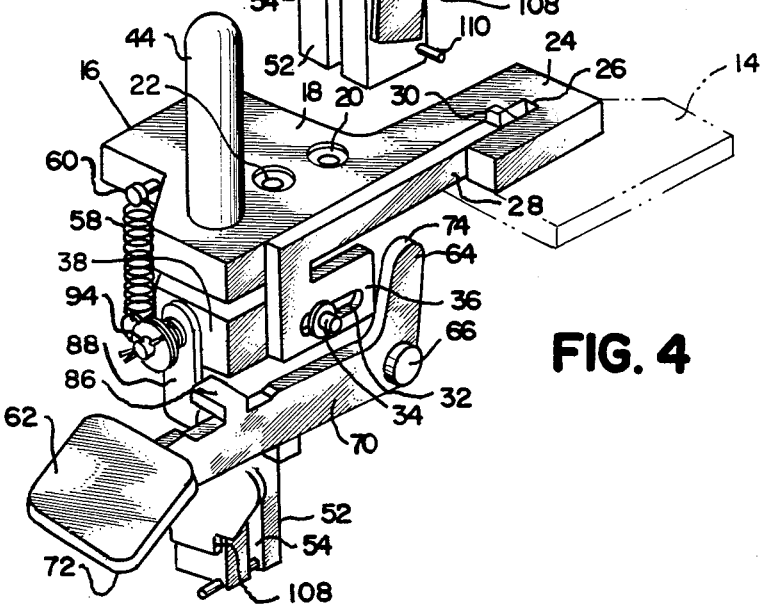
FIG. 4

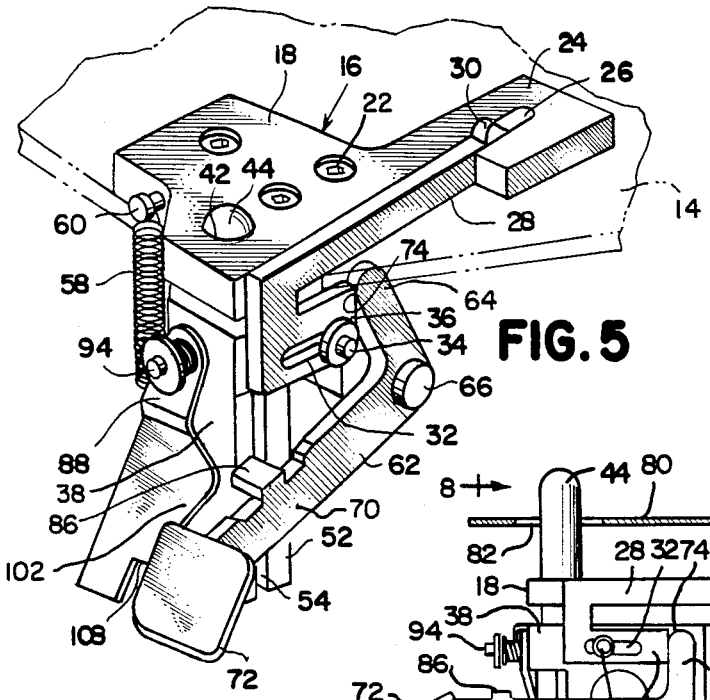
FIG. 5
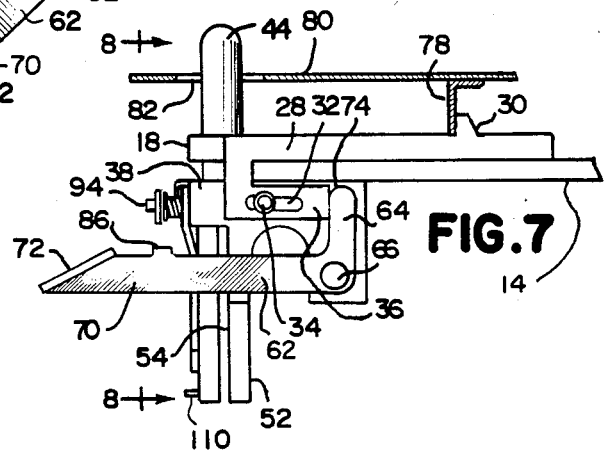
FIG. 7
FIG. 8
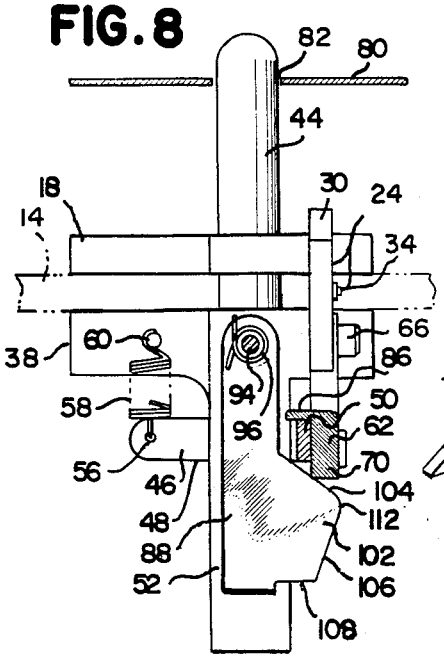
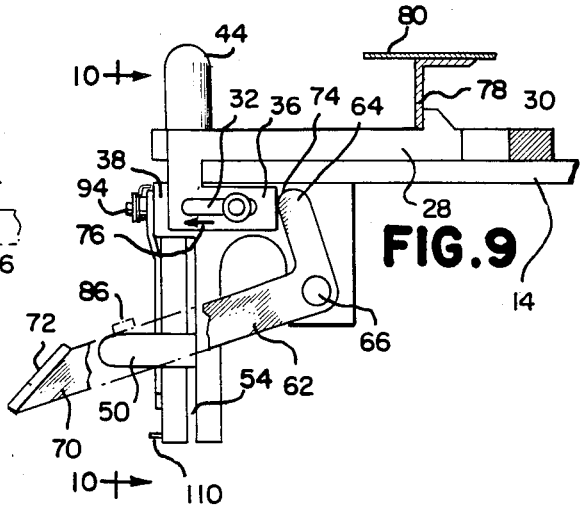
FIG. 9

FIG. 10
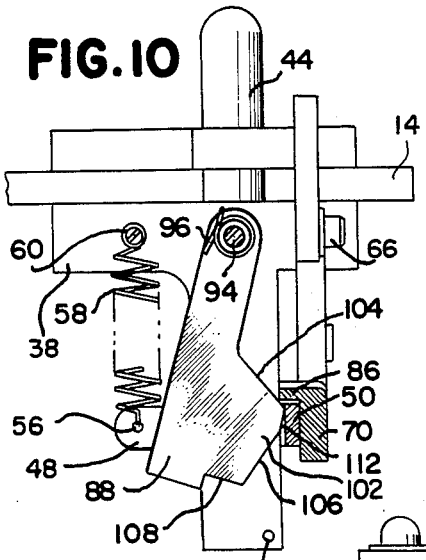
FIG. 12
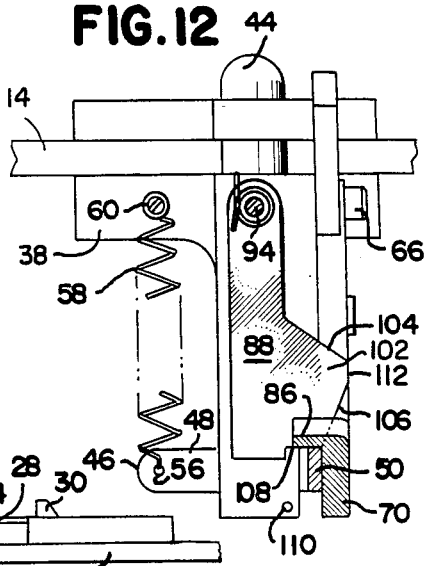
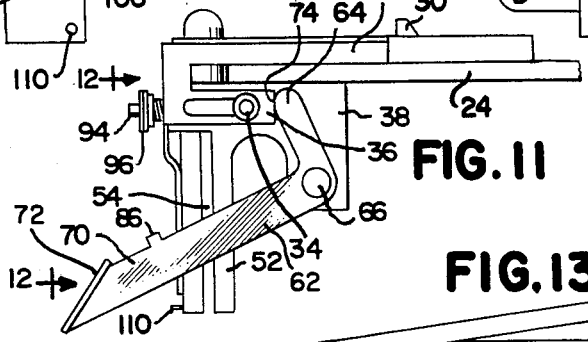
FIG. 11
FIG. 13
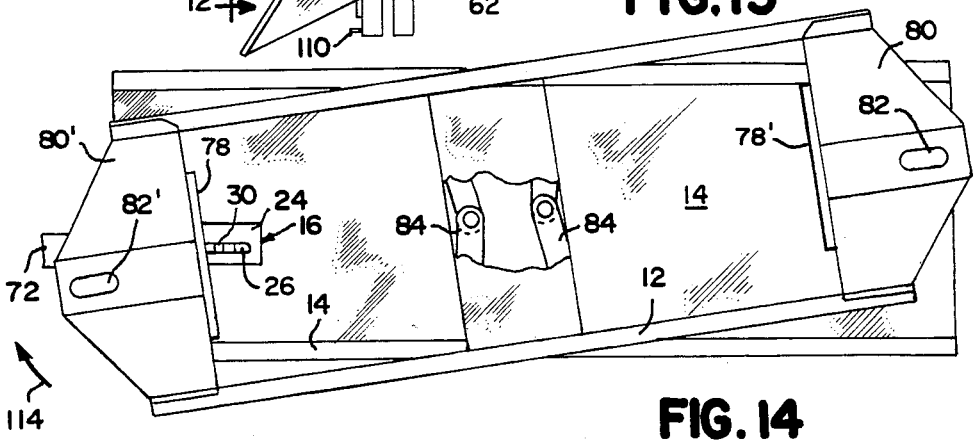
FIG. 14
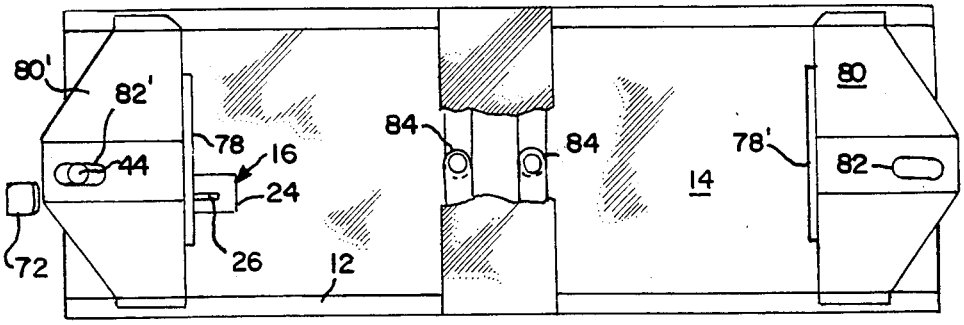

COACH SEAT LOCKING MECHANISM

BACKGROUND OF THE INVENTION

1. Field of the Invention

The present invention relates generally to the field of railroad car equipment, and more particularly, relates to a railroad coach seat anti-rotation and locking mechanism.

2. Description of the Prior Art

Seats in passenger coaches may be either fixed in position or may be equipped with a particularly constructed mechanism which is designed to permit the seat to be reversed or rotated through one hundred and eighty degrees. In the case of fixed seat coaches, when all of the seats are secured to face in the same direction, it is then necessary to actually turn the car completely around when making a return trip. In view of the problems involved in providing the trackage or other construction required to turn the entire car, in most instances, railroads and railway coach designers have preferred to design and construct the coach seats with some type of coach seat reversing mechanism. In this manner, the individual seats can be operated to face in the opposite direction without requiring the turning of the coach itself.

In one popular coach seat design, an upper seat frame has been provided and has been equipped with a suitable turnable or revolving mechanism to allow the upper frame a together with the seat cushions to be revolved relative to a floor affixed lower frame. Accordingly, rather than having to turn the entire coach at the end of a run, all that was required was to revolve each seat upper frame individually relative to its non-movable seat lower frame.

While such seat rotating mechanisms have proved to be both popular and efficient in the past, recent events have demonstrated that this type of seat construction inherently includes a considerable safety hazard to the occupants. In the event of a sudden, unexpected stop, for example, in the case of an accident, railroad and government officials, and others concerned with railway safety, have found that the presently available rotating type seat constructions could not be counted upon to maintain their normally forward orientation. Due to the inability of the seats to remain fixed in position during an emergency situation, that is, facing in the direction of coach movement without rotation, this design flaw has resulted in passenger injuries that could otherwise have been avoided.

Accordingly, the need exists to design and to provide a revolving type of coach seat wherein the seat revolving mechanism can be relied upon to maintain the seat orientation even under the severe conditions and stresses imposed during a high speed crash.

SUMMARY OF THE INVENTION

The present invention relates generally to improved railway coach seat constructions, and more particularly, is directed to a reliable, lockable coach seat anti-rotation and locking mechanism.

The coach seat locking mechanism of the present invention has particularly been developed to be compatible for use with existing rotatable seat designs, such as the coach seat constructions presently being utilized by AMTRAK and perhaps other passenger railway systems. A seat lock and anti-rotation device has been designed for a rotatable type seat which is easily operable between locked and unlocked conditions. The mechanism of the present invention is capable of allowing a coach seat to be rotated when in unlocked position and which is capable of withstanding forces as great as 4*g* when in the locked position to thereby greatly improve the safety capabilities of the seat over the presently available seat locking mechanisms.

In accordance with the teachings of the present invention, the coach seat locking mechanism comprises a foot operated pedal which is pivotally affixed to the seat lower frame and which terminates rearwardly in an integral cam. As the pedal is urged downwardly about its pivot, the cam will simultaneously be pulled forwardly. A rearwardly extending extraction arm is positioned in registry over the pedal and includes a follower in contact with the cam surface. The extraction arm comprises an upwardly extending latch or finger, which finger is adapted to engage a depending portion of the seat upper frame. Accordingly, by depressing the foot pedal about its pivot, the extraction arm will be urged forwardly by the pedal cam to thereby pull or move the seat upper frame outwardly or away from the coach sidewall.

Simultaneously, as the operating pedal is depressed, a locking rod or pin is caused to be lowered or retracted from its engagement with an end positioned cooperating locking plate, which plate is bottomly secured in the seat upper frame, thereby freeing seat the upper frame from restraint against rotation. Once the seat upper frame has been rotated through one hundred and eighty degrees, another upper frame secured locking plate, which is positioned at the opposite end of the frame, will be rotated into registration over the coach seat locking mechanism. With the upper frame in this rotated position, the operating pedal will automatically be spring biased to its initial position, thereby pivotally urging the pedal cam rearwardly. The release of cam pressure upon the extraction arm will free the extraction arm and allow the extraction arm to be returned to its initial position. This in turn will cause the seat upper frame to be urged back to its initial position adjacent to the coach. Simultaneously, the locking rod will be spring biased to its initial, raised position to fully engage within the cooperating opening in the opposite seat upper frame locking plate.

It is therefore an object of the present invention to provide an improved coach seat locking mechanism of the type set forth.

It is another object of the present invention to provide a novel coach seat locking mechanism comprising locking means secured to the seat lower frame. The locking means comprising a foot operated pedal having a cam, the pedal being pivotal between a first, upper locked position and a second lower unlocked position, an extraction arm and a locking rod, the movement of the pedal from its first position to its second position simultaneously causing the cam to activate the extraction arm to pull the seat upper frame away from the coach sidewall and the locking rod to retract from its engagement with an upper frame attached locking plate whereby the seat will be unlocked and can be rotated relative to the seat lower frame.

It is another object of the present invention to provide a novel coach seat locking mechanism to prevent a rotatable type coach seat from rotating under emergency conditions comprising a locking rod means secured to the fixed seat lower frame and locking plate means secured to the seat upper frame, the locking rod means comprising a pivotal, foot operated pedal, an extraction arm and a locking rod, the locking rod being retracted from the locking plate means and the extraction arm simultaneously moving the seat out from the wall when the pedal is depressed to allow rotation of the seat when desired, the locking rod means normally being engaged in the locking plate means to positively prevent unwanted seat rotation.

It is another object of the present invention to provide a novel coach seat locking mechanism that is rugged in construction, simple in design and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

BRIEF DESCRIPTION OF THE DRAWINGS

FIG. 1 is a rear perspective view of a coach seat showing the seat locking mechanism in locked position.

FIG. 2 is a rear perspective view similar to FIG. 1 showing the seat locking mechanism in unlocked position and seat upper frame in partially rotated position.

FIG. 3 is an enlarged left front perspective view of the pedal and locking rod assembly in the seat locking position.

FIG. 4 is an enlarged, right front perspective view of the pedal and locking rod assembly in the seat locking position.

FIG. 5 is an enlarged, right front perspective view similar to FIG. 4, showing the parts in unlocked position.

FIG. 7 is a side elevational view of the pedal and locking rod assembly in the locked position.

FIG. 8 is a front elevational view looking from line 8—8 on FIG. 7.

FIG. 9 is a side elevational view of the pedal and locking rod assembly in intermediate position, with portions broken away to expose interior construction features.

FIG. 10 is a front elevational view looking from line 10—10 on FIG. 9.

FIG. 11 is a side elevational view of the pedal and locking rod assembly in the unlocked position.

FIG. 12 is a front elevational view looking from line 12—12 on FIG. 11.

FIG. 13 is a top plan view showing the relative positions of the upper seat frame and the lower seat frame near the end of seat rotation, with portions broken away to expose interior construction details.

FIG. 14 is a top plan view similar to FIG. 13 showing the parts in completely rotated and locked condition, with portions broken away to expose interior construction details.

DESCRIPTION OF THE PREFERRED EMBODIMENT OF THE INVENTION

Figure 6:
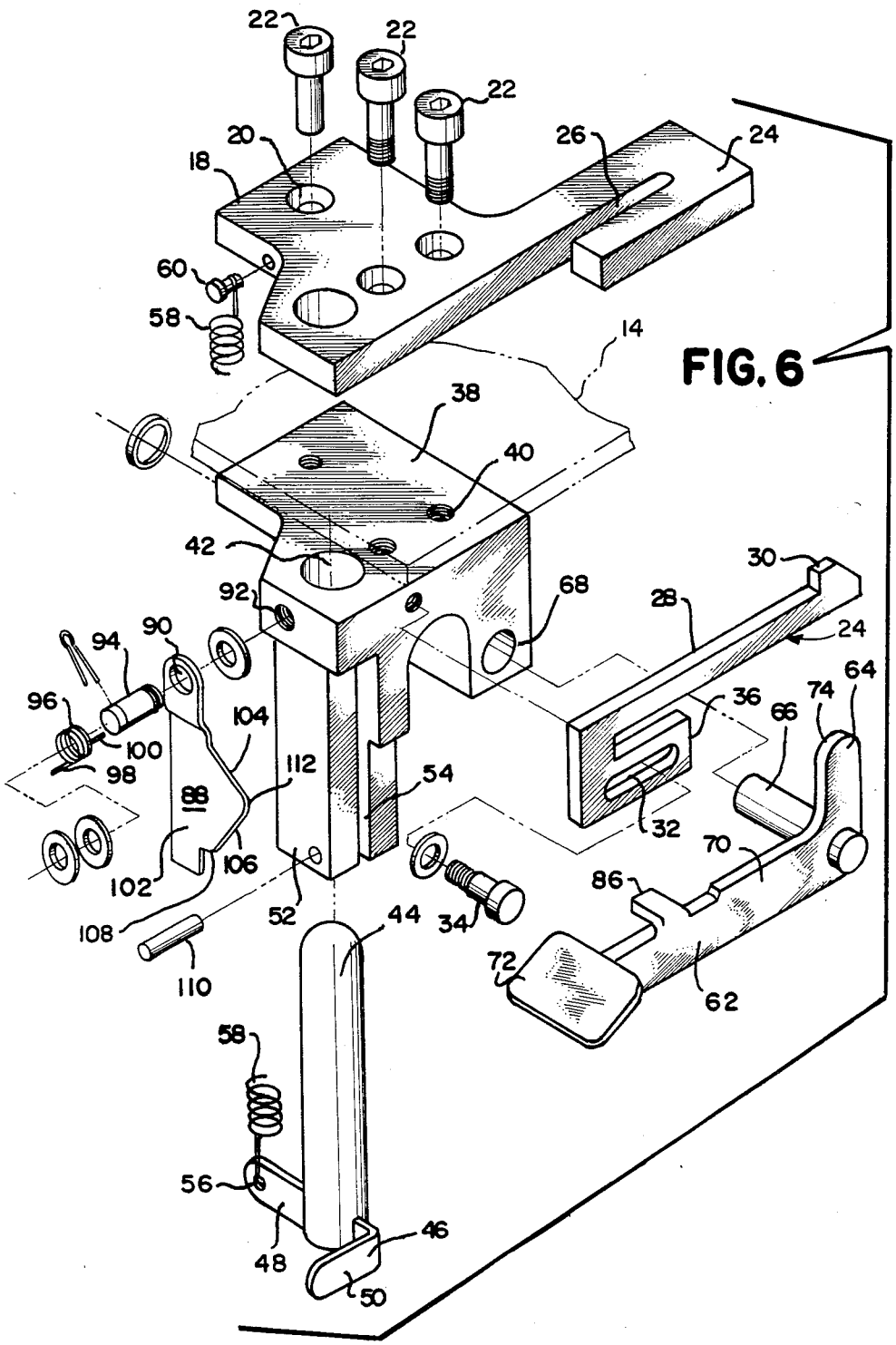
FIG. 6 is an enlarged, perspective, exploded view of the pedal and locking rod assembly.

Although specific terms are used in the following description for the sake of clarity, these terms are intended to refer only to the particular structure of the invention selected for illustration in the drawings, and are not intended to define or limit the scope of the invention.

Referring now to the drawings, there is shown in FIGS. 1 and 2 a conventional swivel type coach seat 10 which comprises generally a seat lower frame 14 and a seat upper frame 12, which upper frame is arranged for rotation relative to the lower seat frame as illustrated in FIG. 2. A pedal and locking rod assembly 16 is affixed to the seat lower frame 14 in secure manner as illustrated to alternately facilitate seat rotation or seat locking as may be desired.

As best seen in FIGS. 3, 4, 5 and 6, the pedal and locking rod assembly 16 cmprises generally an upper body or plate 18 which is provided with a plurality of mounting holes 20 of suitable side to receive threaded or other fasteners 22 therethrough to secure the pedal and locking rod assembly to the seat lower frame 14. The plate 18 extends rearwardly in a J-shaped arm 24 which is configured to define a linear operational slot 26 therein. As shown, an elongated extraction arm 28 has an upwardly extending finger or latch 30 arranged in reciprocal sliding engagement within the operational slot 26 for upper seat movement purposes in the manner hereinafter more fully set forth. The extraction arm 28 is forwardly provided with an elongated slot 32 through which a retaining pin 34 is positioned to permit longitudinal reciprocation of the extraction arm 28. As shown, the extraction arm 28 comprises a lower, rearwardly facing cam follower portion 36 which is maintained in contact with the pedal cam 64 for extraction arm reciprocation as hereinafter more fully described.

Still referring to FIGS. 3, 4, 5 and 6, a stationary block or body 38 is provided with cooperating mounting holes 40 to facilitate securely affixing the body 38 and the upper plate 18 directly to the seat lower frame 14 in a sturdy, immovable manner. The stationary body comprises generally a vertical bore 42 of sufficient length and diameter to permit vertical reciprocation of the locking rod or locking pin 44 therewithin. As shown, the locking rod 44 is reciprocal between a lower, unlocked position as shown in FIGS. 5, 11 and 12 and an upper locking position as illustrated in FIGS. 3, 4, 7 and 8.

As best seen in FIG. 6, the locking rod 44 bottomly carries a bent lever 46 for locking rod operational purposes as the pedal arm or operating lever 62 is moved between its upper and lower positions. The bent lever 46 comprises a diametrically positioned spring arm 48 and an integral, right angle depress arm 50. As illustrated in FIGS. 3 and 6, the depending extremity 52 of the stationary block 38 is provided with a vertical slot 54 in communication with the vertical bore 42 to thereby permit vertical reciprocation of the spring arm 48 therewithin for vertically reciprocating the locking rod 44. The spring arm 48 is endwardly provided with an opening 56 to receive therein the lower end of the operating spring 58 for locking rod operation as hereinafter more fully set forth.

A suitable pin or other known construction 60 projects from the upper plate 18 in vertical registry above the spring opening 56 to provide the upper connection for the coil spring 58. As shown, the spring 58 is arranged to continuously bias the locking rod 44 through the rod affixed arm 48 upwardly to its upper or locking position. See FIGS. 3, 4 and 8. When the locking rod 44 is urged to its lower, unlocked position as illustrated in FIGS. 5, 11 and 12, the spring 58 must be extended as shown and a suitable detent must be provided as hereinafter more fully set forth to restrain normal upward movement of the locking rod under impetus of spring forces.

The pedal arm or operating level 62 is pivotally affixed to the block or body 38 through a pivot pin 66 to allow pivotal movement of the pedal arm or operating lever 62 between its upper, locked position as shown in FIGS. 3, 4 and 7 and its lower, unlocked position as illustrated in FIGS. 5 and 11. The operating lever 62 comprises a forwardly projecting leg 70 which may terminate forwardly in an angled foot pad 72 for convenience in operation and a rearward pedal cam 64, which cam is located on the other side of the pivot 66 from the forward leg 70. As shown, the pedal cam 64 is angularly offset from the axis of the forward leg 70 whereby the contact nose 74 of the cam will be forwardly urged when the pedal arm forward leg 70 is depressed by the actin of the operator's foot (not shown) upon the foot pad 72.

As shown in FIGS. 7, 9 and 11, as the forward leg 70 of the operating lever 62 is depressed from its inital, locking position (FIG. 7) to its final, unlocked position (FIG. 11), the contact nose 74 of the cam 64 will engage the cam follower portion 36 of the extraction arm 28 to force the extraction arm 28 forwardly through the operational slot 26 in the direction illustrated by the arrow 76 (FIG. 9). Forward movement of the extraction arm 28 will move the finger or latch 30 forwardly in engagement with the seat upper frame depending flange 78 to pull the seat upper frame 12 away from the coach sidewall (not shown) for clearance purposes to allow sufficient clearance to allow rotation of the seat upper frame 12 relative to the seat lower frame 14.

Simultaneously, downward urging of the pedal arm forward leg 70 will cause the leg affixed operating finger 86 to engage and push downwardly upon the depress arm 50 of the bent lever 46 to urge the bent lever 46 downwardly against the bias of the locking rod spring 58. The bent lever 46 will ride downwardly within the vertical slot 54 and thereby pull the affixed locking rod 44 downwardly within the vertical bore 42. When the pedal arm 62 is depressed to its lowest position (FIGS. 5, 11 and 12), the locking rod 44 will be pushed to its lowest position and out of contact with the seat upper frame locking plate 80. When the locking rod or pin 44 is pulled clear of engagement with the locking plate 80 at the elongated or slotted opening 82 provided therein, the seat upper frame 12 will then be free to be rotated relative to the seat lower frame 14 about the existing seat rotational linkage 84 (FIGS. 13 and 14) in the usual manner.

A shaped pivotal detent 88 cooperates with the pedal arm or operating lever 62 and is provided with an upper pivot opening 90 through which a pivot pin 94 is positioned to provide pivotal movement of the detent 88 relative to the stationary block 38. A block pivot opening 92 (FIG. 6) is provided to receive and retain the pivot pin 94 in known manner. A weak coil or pivot spring 96 is provided about the pivot pin 94 and has its ends 98, 100 respectively secured in manner to continuously bias the detent 88 in a counter clockwise rotation about the pin 94. The detent 88 comprises a generally triangularly shaped nose 102 which is defined by a downwardly declining upper cam surface 104 and an upwardly inclining lower cam surface 106. The lower cam surface 106 terminates downwardly in a transverse engaging notch 108 which is positioned to temporarily restrain the locking mechanism parts in the unlocked position upon downward activation of the operating lever 62. See FIG. 12.

Referring to FIGS. 8, 10, 12 as the operating lever or pedal arm 62 is downwardly urged from the locked position illustrated in FIG. 8 to the unlocked position illustrated in FIG. 12, the operating finger 86 of the pedal arm forward leg 70 will be in contact with the top surface of the depress arm 50 of the bent lever 46 to simulataneously downwardly urge the bent lever within the body vertical slot 54. This in turn will urge the lever attached locking rod 44 downwardly within its associated bore 42 against the bias of the spring 58, which spring, as previously described, is connected at its lower end to the spring arm 48 of the bent lever 46. As shown, as the pedal arm 62 is downwardly urged, the bottom of the pedal arm will contact and bear against the downwardly declining surface 104 of the pivotal detent 88. See FIG. 3.

The downward vertical movement of the pedal arm 62 in contact with the downward declining surface 104 of the detent will cause clockwise rotation of the detent 88 about its pivot pin 94 against the bias of the pivot spring 96 in the manner shown in FIG. 10. After the lateral extremely 112 of the detent nose 102 is passed by the bent lever 46, the depress arm 50 will ride over the upwardly inclining surface 106 to then allow the pivot spring 96 to pivot the detent in a counter-clockwise direction. The pivotal movement of the detent 88 in clockwise direction will clear the downward path of the pedal arm 62 and allow the pedal arm to reach its lowest limit of travel, as illustrated in FIG. 12. If desired, a bottom limit pin 110 may be employed in known manner to limit downwardly movement of the locking rod 44 within the bore 42.

When the pedal arm 62 reaches its lowest travel position, the detent engaging notch 108 will cause sufficient clearance between the depress arm 50 and the detent 88, thereby allowing the pivot spring 96 to bias the detent to return to its original, generally vertical orientation. The engaging notch 108 will then be in direct contact with the top surface of the depress arm 50 in such manner as to secure the mechanism parts in the unlocked position. In this position, as shown in FIG. 12, the locking rod 44 will be completely depressed and out of contact with the elongated opening 82 of the seat upper frame affixed locking plate 80 or 80'. The seat upper frame 14 can then be rotated about the seat rotational linkage 84 relative to the seat lower frame 12 in the manner illustrated in FIGS. 2 and 13.

As shown in FIGS. 13 and 14, as an upper frame locking plate 80', which is secured at the opposite end of the seat upper frame 12, is rotationally urged toward registry over the pedal and locking rod assembly 16, the locking plate depending flange 78' will engage the upwardly projecting latch or finger 30 of the extraction arm 28 and will cause the extraction arm to move rearwardly within the operational slot 26 to its rearwardmost position as allowed by the elongated slot 32. this rearward movement of the extraction arm 28 will cause the cam follower portion 36 to bear agaisnt the contact nose 74 of the pedal cam 64. This in turn will cause clockwise rotation of the pedal arm 62 about its pivot pin 66 and will cause a portion of the upper surface of the pedal arm forward leg 70 to upwardly contact and bear against the upwardly inclining surface 106 of the detent 88.

The upward forces acting upon the upwardly inclining surface 106 will in turn cause clockwise rotation of the detent 88 about its pivot pin 94 against the bias of the pivot spring 96 to thereby free the bent lever depress arm 50 from engagement with the detent notch 108. The clockwise rotation of the detent 88 will then allow the spring 58 (acting through the spring arm 48) to automatically elevate the locking rod 44 to its locked position. In the locked position, the locking rod 44 will be fully engaged within and seated in an elongated opening 82 of an upper frame locking plate 80 or 80'. See FIGS. 7, 8 and 14. Because of the sturdy construction and position of the pedal and locking rod assembly 16 upon the seat lower frame 14 and the cooperating strong locking plate construction of the seat upper frame 12, an extremely strong, dependable and easily workable coach seat locking mechanism has been provided.

Although the invention has been described with a certain degree of particularity, it is understood that the present disclosure has been made only by way of example and that numerous changes in the details of construction and the combination and arrangement of parts may be resorted to without departing from the spirit and scope of the invention. Thus, the scope of the invention should not be limited by the foregoing specification, but rather, only by the scope of the claims appended hereto.

What is claimed is:

1. A seat locking mechanism for coach seats of the type comprising a fixed seat lower frame and a seat upper frame rotatable about the lower frame comprising a sturdy body secured to the seat lower frame, the body being provided with a vertical bore;

a pedal arm pivotally secured to the body, the pedal arm comprising a forwardly extending forward leg and a pedal cam, the pedal cam being moved when the forward leg is moved, the pedal arm being movable between a first, upper position and a second, lower position;

an extraction arm secured to the body and having reciprocal motion between a first, rearward position and a second, forward position relative to the body, the extraction arm comprising a cam follower portion in contact with the said pedal cam;

a locking rod means vertically reciprocal within the said vertical bore between an upper, locked position and a lower, unlocked position to alternately lock and unlock the seat upper frame relative to the seat lower frame, the locking rod means comprising a locking rod and a lever connected to and extending outwardly from the locking rod;

spring means biasing between a portion of the body and the lever to continuously bias the locking rod toward its said upper, locked position; and operating finger means extending from the forward leg of the pedal arm to engage a portion of the locking rod means lever;

whereby the movement of the pedal arm from its first position to its second position will cause simultaneous movement of the extraction arm to its forward position and movement of the locking rod means to its lower, unlocked position.

2. The seat locking mechanism of claim 1 wherein the pedal arm is pivotally secured to the body by a pivot pin and wherein the pivot pin is positioned on the pedal arm intermediate the forward leg and the pedal cam.

3. The seat locking mechanism of claim 2 wherein the pedal cam is positioned in angularly offset orientation to the forward leg.

4. The seat locking mechanism of claim 3 wherein the angular offset is about ninety degrees.

5. The seat locking mechanism of claim 1 wherein the extraction arm comprises an upwardly projecting latch, the latch extending in height a distance sufficient to contact the seat upper frame.

6. The seat locking mechanism of claim 1 wherein the vertical bore is provided with a vertical slot and wherein the locking rod means lever is positioned within the slot.

7. The seat locking mechanism of claim 6 wherein the lever is bent to define a spring arm and a depress arm, the said spring means bieng connected to the spring arm.

8. The seat locking mechanism of claim 7 and a detent pivotally secured in the body, the detent being contacted by the said depress arm.

9. The seat locking mechansism of claim 8 and a pivot spring in contact with the detent, the pivot spring continuously biasing the detent toward the depress arm.

10. The seat locking mechanism of claim 8 wherein the detent comprises a shaped nose defined by a downwardly declining upper surface, the upper surface being contacted by the depress arm as the pedal arm is downwardly moved.

11. The seat locking mechanism of claim 10 wherein the detent nose is define by an upwardly inclining lower surface, the lower surface being contacted by the depress arm as the pedal arm is upwardly moved.

12. In a coach seat construction of the type including a seat lower frame affixed to the floor of the coach, a seat upper frame rotatively secured is the seat lower frame, the respective frames each having a first or forward end and a second or rearward end and a seat rotation mechanism positioned intermediate the upper and lower frames, the seat rotation mechanism being spaced from the said first and second ends and being centrally located relative to the frames, the improvement comprising a body secured to the seat lower frame at the forward end thereof, the body being positioned in spaced relationship from the seat rotation mechanism, the body being provided with a vertical bore;

pedal arm means pivotally attached to the body to selectively lock the forward end of the seat lower frame to an end of the seat upper frame, the pedal arm means comprising a pedal arm and a pivot pivotally connecting the pedal arm to the body, the pedal arm being movable between a first, locked position and a second, unlocked position;

locking rod means vertically reciprocable within the said vertical bore between a first, locked position and a second, unlocked position, the locking rod means comprising a locking rod and a lever connected to and extending outwardly from the locking rod, the locking rod extending upwardly and engaging a portion of the seat upper frame when the locking rod means is reciprocated to the first position, the locking rod preventing rotation of the seat upper frame relative to the seat lower frame when in the first position;

spring means biasing between a portion of the body and the lever to continuously bias the locking rod to the first, locked position; and operating finger means extending from the pedal arm to contact the lever, the operating finger means urging the locking rod from its first, locked position to its second, unlocked position against the bias of the spring means when the pedal arm is moved from its first, locked position to its second, unlocked position.

13. The coach seat construction of claim 12 wherein the pedal arm comprises a forward leg extending forwardly of the pivot and a pedal cam positioned rearwardly of the pivot.

14. The coach seat construction of claim 13 and an extraction arm movable secured to the body, the extraciton arm having reciprocal motion between a first, rearward position and a second, forward position, the extraction arm comprising a cam follower and an upwardly extending latch.

15. The coach seat construction of claim 14 wherein the cam follower is maintained in contact with the pedal cam whereby the extraction arm is moved from its first position to its second position by the interaction of the pedal cam and the cam follower when the pedal arm is moved from the first position to the second position.

16. The coach seat construction of claim 15 wherein the extraction arm latch extends upwardly sufficiently to engage a portion of the seat upper frame near one end thereof, the extraction arm pulling the seat upper frame forwardly when the extraction arm is moved toward is second position.

17. The coach seat construction of claim 12 and a detent pivotally connected to the body, the detent being positioned to be contacted by the lever to pivot the detent when the locking rod is urged from it first position toward its second position.

18. The coach seat construction of claim 17 wherein the detent comprises a bottom notch, the notch bearing against the locking rod lever when the locking rod means is reciprocated to its said second, unlocked position to maintain the locking rod means in the unlocked position.

19. The coach seat construction of claim 18 wherein the detent comprises a configured nose above the said notch, the nose being defined by a downwardly declining surface and an upwardly inclining surface, the downwardly declining surface being contacted by the pedal arm when the pedal arm is moved from its first position to its second position and the upwardly inclining surface being contacted by the pedal arm when the pedal arm is moved from its second position to its said first position.

* * * * *